US008555933B2

(12) United States Patent
Houser et al.

(10) Patent No.: US 8,555,933 B2
(45) Date of Patent: Oct. 15, 2013

(54) WIRE UNTWISTING TOOL

(75) Inventors: Matthew Steven Houser, Jonestown, PA (US); Richard Lloyd Schaeffer, Carlisle, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 661 days.

(21) Appl. No.: 12/509,015

(22) Filed: Jul. 24, 2009

(65) Prior Publication Data

US 2011/0017342 A1 Jan. 27, 2011

(51) Int. Cl.
*B21F 7/00* (2006.01)

(52) U.S. Cl.
USPC ..... 140/118; 140/117; 140/149

(58) Field of Classification Search
USPC ..... 140/117, 118, 120, 123, 147, 149, 93.6, 140/119; 29/270, 461, 750, 764; 7/107
See application file for complete search history.

(56) References Cited

U.S. PATENT DOCUMENTS

| | | | | |
|---|---|---|---|---|
| 2,998,034 | A * | 8/1961 | Mann et al. | 140/123 |
| 3,736,606 | A | 6/1973 | Raum et al. | |
| 3,875,601 | A | 4/1975 | Kaufman | |
| 3,994,320 | A * | 11/1976 | Dorsey et al. | 140/124 |
| 4,152,797 | A | 5/1979 | Wells, Jr. | |
| 4,366,619 | A | 1/1983 | Bieganski | |
| 4,620,573 | A | 11/1986 | Meder | |
| 4,805,302 | A | 2/1989 | Steiner | |
| 5,435,029 | A | 7/1995 | Carlson, Jr. et al. | |
| 5,659,948 | A | 8/1997 | Vanderhoof et al. | |
| 5,771,945 | A | 6/1998 | Jenner et al. | |
| 5,957,685 | A * | 9/1999 | Kanno | 140/93.6 |
| 7,003,883 | B2 | 2/2006 | Tapper | |
| 7,104,287 | B1 | 9/2006 | Schmitz | |
| 7,316,058 | B2 | 1/2008 | Jee | |
| 2006/0000517 | A1 | 1/2006 | Enloe | |

OTHER PUBLICATIONS

Belden Cable Preparation Tool, 2 pgs.

* cited by examiner

*Primary Examiner* — Teresa M Ekiert

(57) ABSTRACT

A wire untwisting tool includes a housing having a wire gripping end, an actuation end and a cavity. A plunger is received in the cavity. The plunger is movable between a retracted position and an actuated position and includes a gripping head movable with the plunger between the retracted position and the actuated position. The gripping head is configured to hold the twisted pair of wires in the retracted position, wherein rotation of the housing in an untwisting direction untwists the wires. Optionally, the wire may be fixedly held remote from the gripping end, and the housing may be rotated about the location at which the wire is fixedly held.

20 Claims, 5 Drawing Sheets

WIRE UNTWISTING TOOL

BACKGROUND OF THE INVENTION

The subject matter herein relates generally to cables having twisted wire pairs, and more particularly, to untwisting tools for the twisted wire pairs.

Cables in the telecommunications, electronics and computer industries utilize shielded and unshielded twisted pairs of wires. The wires are terminated to an electrical connector provided at an end of the cable. During termination, the twisted pairs of wires are exposed and portions of the wires are untwisted and straightened. The individual wires of the pair are then terminated to the electrical connector.

Common examples of such cables typically include four twisted pairs of wires that must be untwisted before they can be properly terminated. A common method for untwisting the twisted pairs is untwisting the wires by hand. Hand untwisting is slow, can irritate the skin, and does not effectively straighten the wires. Another common method for untwisting the wires is known as the "pick method". The pick method entails a user placing a metal or plastic awl between the length of twisted wires and pulling the awl toward the cut ends of the wires. The pick method is not without disadvantages. For instance, the awl may damage the wires as the awl is pulled towards the cut ends. Additionally, the pick method cannot untwist all types of wires. The pick method may not straighten the wires when the wires are untwisted. Some tools have been developed to untwist the twisted pairs of wires. For example, electrically driven tools are known for untwisting the wires. However, such tools are bulky, heavy and expensive. A need remains for a tool that untwists twisted pairs of wires easily and reliably.

BRIEF DESCRIPTION OF THE INVENTION

In one embodiment, a wire untwisting tool is provided including a housing having a wire gripping end, an actuation end and a cavity. A plunger is received in the cavity. The plunger is movable between a retracted position and an actuated position and includes a gripping head movable with the plunger between the retracted position and the actuated position. The gripping head is configured to hold the twisted pair of wires when the tool is in the retracted position, wherein rotation of the housing in an untwisting direction untwists the wires. Optionally, the wire may be fixedly held remote from the gripping end, and the housing may be rotated about the location at which the wire is fixedly held.

In another embodiment, a wire untwisting tool is provided that includes a housing having a wire gripping end and an actuation end. The housing has a cavity and a plunger is received in the cavity. The plunger is movable between a retracted position and an actuated position, and the plunger has a gripping head movable with the plunger between the retracted position and the actuated position. The gripping head is configured to hold the twisted pair of wires when the tool is in the retracted position. A finger ring is positioned outward of the actuation end of the housing. The finger ring is configured to receive an operator's finger and is configured to spin about the operator's finger when the housing is rotated in an untwisting direction. Rotation of the housing in the untwisting direction untwists the wires.

DETAILED DESCRIPTION OF THE INVENTION

Figure 1:
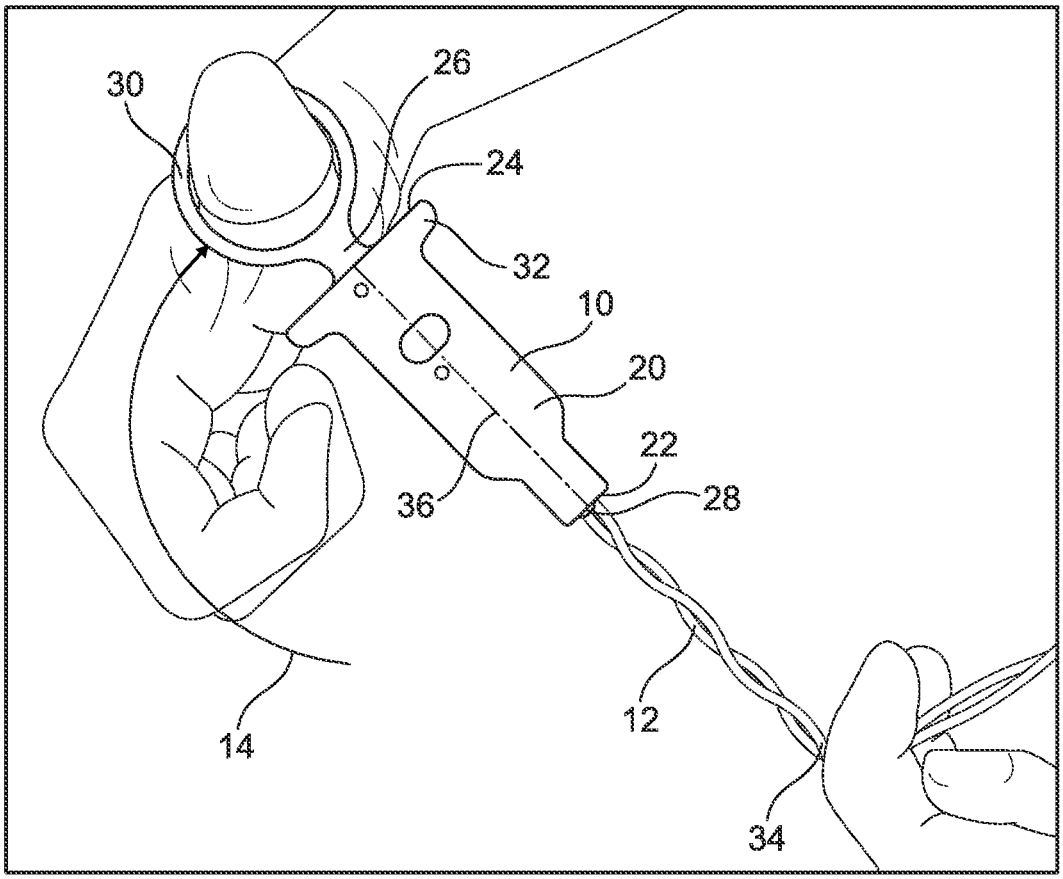
FIG. 1 is a perspective view of a wire untwisting tool in accordance with an exemplary embodiment.

FIG. 1 is a perspective view of an exemplary embodiment of a wire untwisting tool 10 used for untwisting a twisted pair of wires 12. The tool 10 is a handheld tool capable of moving in an untwisting direction 14 to untwist the wires. For example, the tool 10 is held by an operator and rotated in the untwisting direction numerous times to untwist the wires.

The tool 10 includes a housing 20 having a wire gripping end 22 at a front of the housing 20 and an actuation end 24 at a rear of the housing 20. The tool 10 includes a plunger 26 received in housing 20. The plunger 26 is movable within the housing 20 between a retracted, or rearward, position and an actuated, or forward, position. The housing 20 and the plunger 26 may be manufactured from a plastic material, however other materials such as metal materials, may be suitable in alternative embodiments.

A gripping head 28 is provided at a front of the plunger 26. The gripping head 28 is movable with the plunger 26 between the retracted position and the actuated position. The gripping head 28 holds the wires 12.

A finger ring 30 is provided at the rear of the plunger 26. The finger ring 30 is configured to receive one of the operator's fingers so that the operator can hold the tool 10. In an exemplary embodiment, the finger ring 30 receives the operator's thumb. Alternatively the finger ring 30 may receive any of the operator's fingers. As the tool 10 is moved in the untwisting direction 14, the finger ring 30 spins about the operator's finger. As such, the too 10 changes position relative to the operator's hand as the tool 10 is moved in the untwisting direction 14. In an exemplary embodiment, the housing 20 includes a finger grip 32 at the actuation end 24. The finger grip 32 is configured to receive one or more of the operator's fingers.

In operation, the tool 10 is used to clamp on to an end of the wire 12, and then the tool is manipulated to untwist the twisted wire pair. To clamp the tool 10 to the twisted wire pair, the operator grips the finger grip 32 with his or her index finger and middle finger and places his or her thumb in the finger ring 30. Other gripping arrangements are possible. The operator pushes the finger ring 30 and/or pulls the finger grip 32 to actuate the plunger 26 from the retracted position to the actuated position. In the actuated position, the gripping head 28 extends from the wire gripping end 22 of the housing 20. In an exemplary embodiment, the gripping head 28 constitutes a hook. The operator loads the twisted pair of wires 12 into the gripping head 28. The operator then allows the plunger 26 to return to the retracted position, which also resets the gripping head 28 to the retracted position. In an exemplary embodiment, the wires 12 are secured by the gripping head 28. For example, the wires 12 may be pinched between the wire gripping end 22 and the gripping head 28.

The wires 12 may be creased as the wires 12 are pulled back against the wire griping end 22.

To untwist the wires 12, the operator fixedly secures a portion of the wires 12 remote from the tool 10. For example, the operator may hold the wires 12 with the operator's other hand. Alternatively, the operator may use another device or tool to fixedly hold the wires 12. In the illustrative embodiment, the wires 12 are held at a fixed point generally designated by the reference numeral 34. The fixed point 34 is located a distance from the wire gripping end 22 of the tool 10. As such, a length of the wires 12 extends between the fixed point 34 and the gripping head 28. The portion of the wires 12 between the fixed point 34 and the tool 10 is the portion of the wires 12 that is, to be untwisted. The wires 12 are twisted along the length between the fixed point 34 and the tool 10 any number of times.

The operator holds the tool 10 by placing a finger, such as a thumb or an index finger, in the finger ring 30. The operator pulls the tool 10 rearward such that the wires 12 are generally taut. When pulled taut, the wires 12 generally extend along a longitudinal axis 36 of the tool 10. The longitudinal axis 36 extends between the wire gripping end 22 and the actuation end 24. The operator then twirls his or her finger in a circular motion 14. The tool 10 is rotated about the fixed point 34. With the wires 12 held at the fixed point 34, the twirling action causes the twisted wires 12 to untwist. By pulling the wires 12 taut during the untwisting process, the wires 12 may be straightened. After the wires 12 are untwisted, the operator can again actuate the plunger 26 to extend the gripping head 28, allowing the now untwisted wires 12 to be released from the tool 10.

Figure 2:
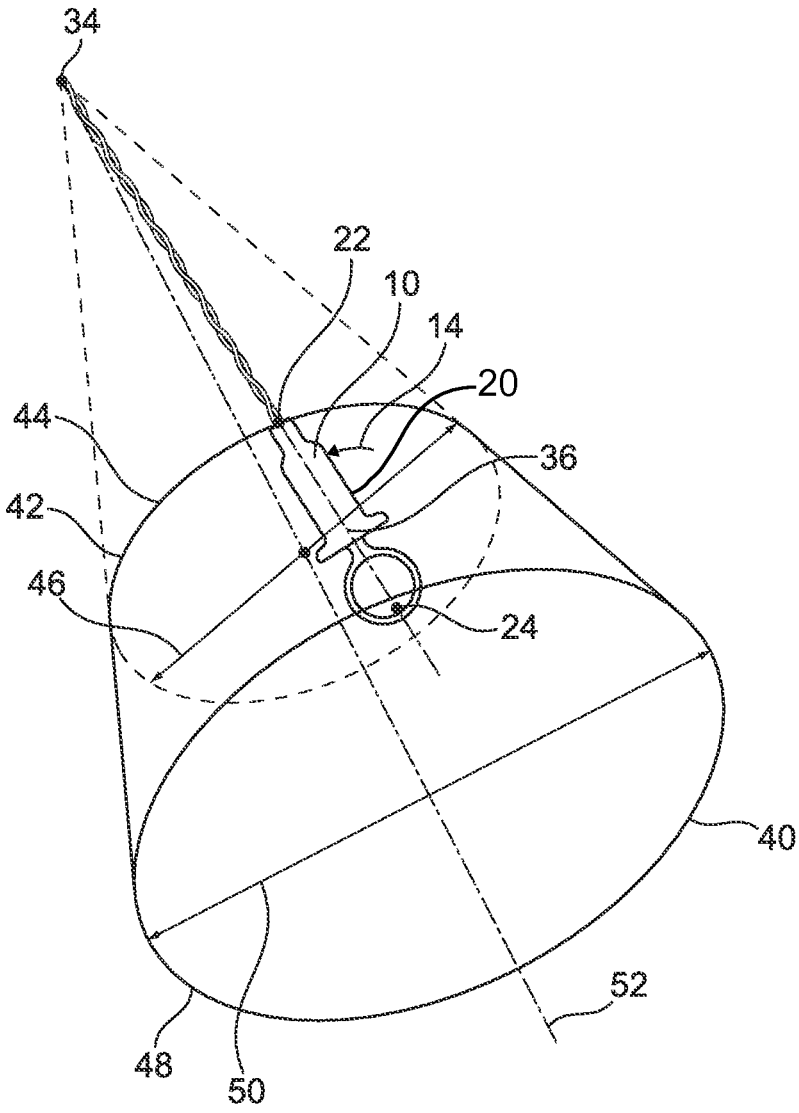
FIG. 2 illustrates an exemplary motion profile of the wire untwisting tool shown in FIG. 1.

FIG. 2 illustrates an untwisting motion profile of the wire untwisting tool 10. The tool 10 is rotated in the untwisting direction 14 about the fixed point 34 in a circular motion. The tool 10 is rotated in the untwisting direction 14 such that the tool 10 is pivoted about the fixed point 34 in a direction generally perpendicular with respect to the longitudinal axis 36, such as in a tangential direction. The motion profile of the tool 10 during the untwisting process generally follows a frustoconical path, with the actuation end 24 positioned at a base 40 of a frustum of the cone defined between the fixed point 34, which is at the tip of the cone, and the base or the cone. The wire gripping end 22 is positioned at a top 42 of the frustum. Optionally, the tip of the cone may not be coincident with the fixed point 34. For example, longitudinal axis 36 of the tool 10 may be nonparallel to the wires 12 extending between the fixed point 34 and the wire gripping end 22.

The housing 20 of the tool 10 is rotated in the untwisting direction 14 such that the wire gripping end 22 moves circumferentially along a first path 44 having a first diameter 46. The actuation end 24 moves circumferentially along a second path 48 having a second diameter 50 longer than the first diameter 46. The tool 10 is generally rotated about a central axis 52 and extends from the fixed point 34. The tool 10 is held such that the longitudinal axis 36 is angled with respect to the central axis 52 with the wire gripping end 22 closer to the central axis 52 and with the actuation end 24 further from the central axis 52. As such, the first path 44 is smaller than the second path 48.

In an alternative embodiment, rather than having the longitudinal axis 36 being generally parallel to the wires 12, the tool 10 may be held such that the longitudinal axis 36 is generally parallel to the central axis 52. As such, when the tool 10 is rotated about the central axis 52, the wire gripping end 22 and the actuation end 24 travel along first and second paths 44, 48 that are similar in size. The motion profile of the tool 10 is generally cylindrical shape in such a situation as opposed to frustoconical in shape. In another alternative embodiment, the tool 10 may be held such that the wire gripping end 22 is further from the central axis 52 and the actuation end 24 is closer to the central axis 52. As such, when the tool 10 is rotated about the central axis 52, the wire gripping end 22 travels along the first path 44 that is longer than the second path 48 of the actuation end 24. The motion profile of the tool 10 is reverse frustoconical in shape from the motion profile illustrated in FIG. 2. The orientation of the tool 10 with reset to the central axis 52 may change during the rotation of the tool 10 about the central axis 52. The position of the fixed point 34 may change during rotation of the tool 10.

As the tool 10 is rotated in the untwisting direction 14 about the central axis 52, the tool 10 is also rotated about the longitudinal axis 36. For example, the housing 20 may turn approximately 360° about the longitudinal axis 36 for each complete revolution of the tool 10 about the central axis 52. Such turning of the housing 20 causes the wires to untwist as the tool 10 is moved along the path.

Figure 3:
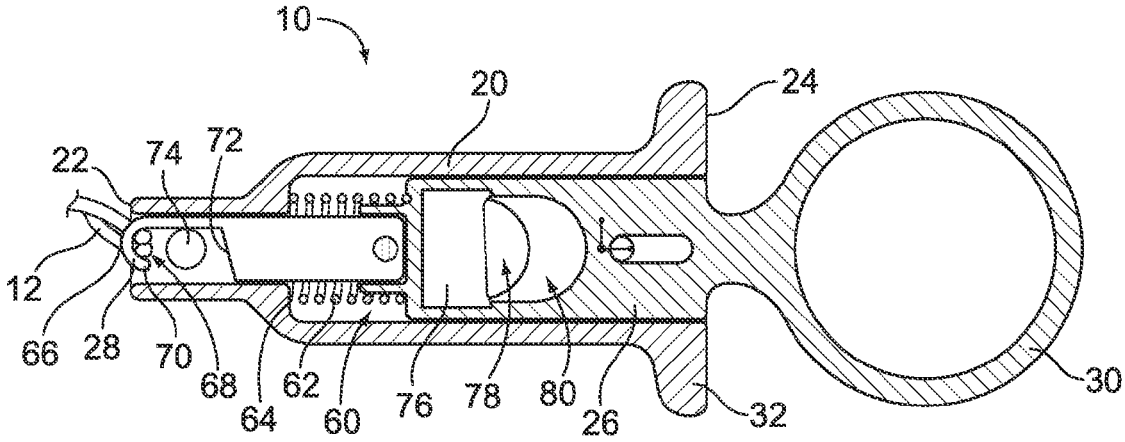
FIG. 3 is a cross-sectional view of the wire untwisting tool shown in FIG. 1 in a retracted state.

FIG. 3 is a cross-sectional view of the wire untwisting tool 10 in a retracted state. The housing 20 includes a cavity 60 extending between the wire gripping end 22 and the actuation end 24. The cavity 60 is open at the wire gripping end 22 and at the actuation end 24. The cavity 60 is stepped down proximate to the wire gripping end 22. The plunger 26 and gripping head 28 are both received within the cavity 60. In the illustrated embodiment the gripping head 28 is separate and distinct from the plunger 26 and coupled thereto. In an alternative embodiment, the plunger 26 and gripping head 28 may be a single, unitary component.

A biasing mechanism 62 is also received in the cavity 60. The biasing mechanism 62 extends between the housing 20 and the plunger 26. The biasing mechanism 62 is used to force the plunger 26 rearward to the retracted position. When the plunger 26 is not being actuated by the operator, the plunger 26 is normally positioned in the retracted position. The biasing mechanism 62 is used to automatically return the plunger 26 to the retracted position. In the illustrated embodiment, the biasing mechanism 62 engages a shoulder 64 defined within the cavity 60. The biasing mechanism 62 also engages a front end of the plunger 26. The gripping head 28 extends through the biasing mechanism 62. In an exemplary embodiment, the biasing mechanism 62 is a coil spring. Alternatively, other types of springs or other types of biasing mechanisms may be used to force the plunger 26 to the retracted position.

The gripping head 28 includes a hook 66 at the distal end thereof. The hook 66 is used to capture the wires 12 and hold the wires 12 during use. The hook 66 has an inwardly facing pocket 68 that receives the wires 12. The hook 66 extends to a tip 70. The tip 70 wraps around the wires to capture the wires within the pocket 68. In the retracted position, the tip 70 is at least partially received within the cavity 60. For example, the gripping head 28 is pulled into the cavity 60 such that the tip 70 is positioned inward from the wire gripping end 22. Alternatively, the tip 70 may not be positioned in the cavity 60 in the retracted position. For example, the wire diameter may be relatively large, thus preventing the tip 70 from being received within the cavity 60.

In an exemplary embodiment, the gripping head 28 includes a cutting blade 72. The housing 20 includes a window 74 generally aligned with the cutting blade 72 that opens to the cavity 60. Optionally, the housing 20 may include windows 74 on both sides thereof so that a portion of the cable may extend entirely through the housing 20 and through both windows 74. In an exemplary embodiment, the windows 74 may receive a cable filler or other portion of the cable therethrough. The cutting blade 72 is configured to cut the cable filler. Alternatively, the windows 74 may receive ends of the wires 12. The cutting blade 72 may be used to cut the wires. Optionally, the cutting blade 72 may be used to cut the sheath surrounding the wires 12, such as to expose and end portion of the wires 12. In another alternative embodiment, the windows, 74 receive a cable. The cutting blade 72 may be used to cut the jacket surrounding the cable such that the jacket may be stripped from the end of the cable to expose the wires 12.

In an exemplary embodiment, the plunger 26 includes a cutting blade 76. The housing 20 includes a window 78 generally aligned with cutting blade 76 that opens to the cavity 60. Optionally, the housing 20 may include windows 78 on both sides thereof so that a portion of the cable may extend entirely through the housing 20 and through both windows 78. The plunger 26 also includes an opening 80 rearward of the cutting blade 76 that allows the cable to pass through the plunger 26. In an exemplary embodiment, the plunger 26 is actuated to the actuated position, such as the position shown in FIG. 4, to align the opening 80 with the windows 78. The cable is loaded through the windows 78 and the opening 80. The plunger 26 is released and moved rearward until the cutting blade 76 engages the jacket of the cable. The tool 10 may be rotated about the cable to cut a slit in the jacket. Alternatively, the cable may be rotated within the tool 10 to cut a circumferential slit around the cable. The jacket may then be stripped from the end of the cable to expose the wires 12. The cutting blade 76 on the plunger 26 may be used to cut other portions of the cable as well, such as a cable filler or an individual wire.

The finger ring 30 is integrally formed with the plunger 26 and extends from a rear end of the plunger 26. The finger ring 30 is located external to the cavity 60. The finger grip 32 is formed integral with the housing 20 and is provided at the actuation end 24 thereof.

Figure 4:
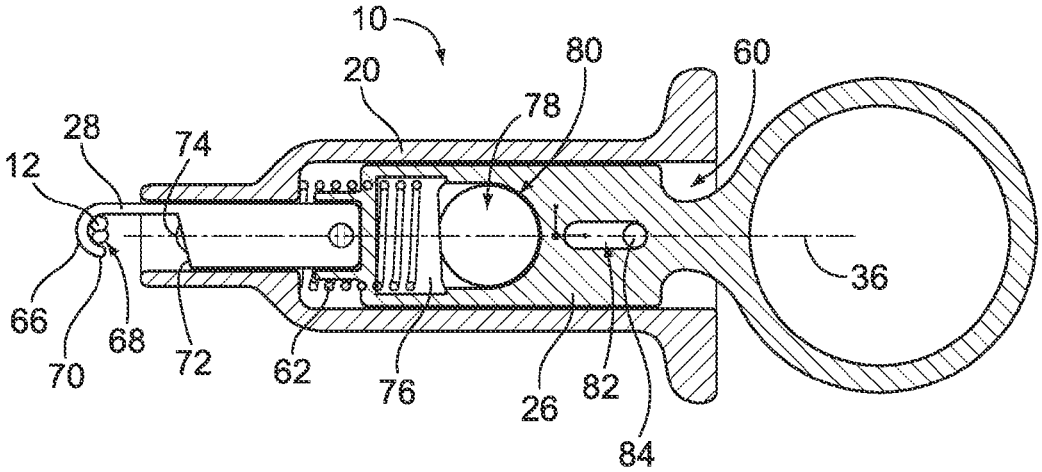
FIG. 4 is a cross-sectional view of the wire untwisting tool shown in FIG. 1 in an advanced state.

FIG. 4 is a cross-sectional view of the wire untwisting tool 10 in an advanced state. In the advanced state the plunger 26 and the gripping head 28 are actuated forward within the cavity 60. When actuated, the gripping head 28 is advanced out of the cavity 60 to expose the hook 66. In the advanced position, the tip 70 is positioned external of the wire gripping end 22. The pocket 68 is exposed and is configured to receive the wires 12 therein.

When the gripping head 28 is advanced, the cutting blade 72 is also advanced. The cutting blade 72 shears the cable filler or wire received in the windows 74.

When the plunger 26 is advanced, the opening 80 in the plunger 26 is aligned with the windows 78 in the housing 20. The cable is able to pass through the housing 20 until a portion of the jacket is aligned with cutting blade 76. The biasing mechanism 62 is compressed when the plunger 26 is advanced. When the plunger 26 is released, the biasing mechanism 62 forces the plunger 26 to return to the retracted position. When the cable is loaded through the windows 78, the biasing mechanism 62 forces the plunger 26 in the rearward direction until the cutting blade 76 engages the jacket of the cable. In this manner, the jacket may be cut and then stripped from the end of the cable.

In an exemplary embodiment, the plunger 26 includes an elongated channel 82 that extends along the longitudinal axis 36. A post 84 extends from the housing 20 into the channel 82. The post 84 rides in the channel 82 as the plunger 26 is actuated to control the range of motion of the plunger 26 with respect to the housing 20. The post 84 and channel 82 guide the plunger 26 within the cavity 60 and resist rotation of the plunger 26 within the cavity 60.

Figure 5:
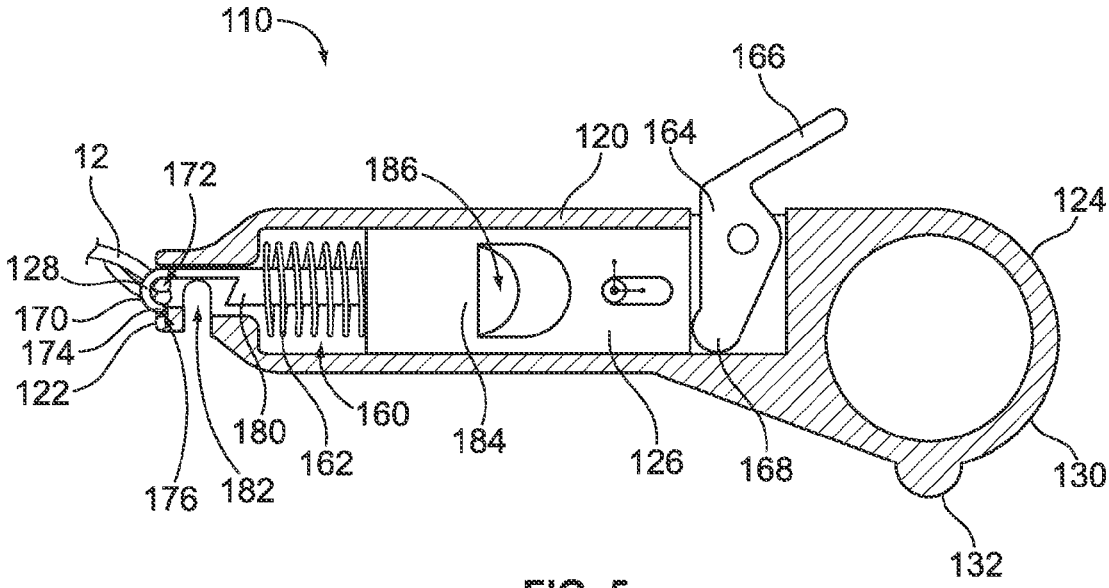
FIG. 5 is a cross-sectional view of an alternative wire untwisting tool in a retracted state.

FIG. 5 is a cross-sectional view of an alternative wire untwisting tool 110 in a retracted state. The tool 110 includes a housing 120 having a wire gripping end 122 at a front of the housing 120 and an actuation end 124 at a rear of the housing 120. The tool 110 includes a plunger 126 received in a cavity 160 of the housing 120. The plunger 126 is movable within the cavity 160 between a retracted, or rearward, position (shown in FIG. 5) and an actuated, or forward position (shown in FIG. 6).

A gripping head 128 is provided at a front of the plunger 126. The gripping head 128 is movable with the plunger 126 between the retracted position and the actuated position. The gripping head 128 holds the wires 12. In an exemplary embodiment, the gripping head 128 is separately provided from the plunger 126, and is coupled to the plunger 126 such that the gripping head 128 is movable with the plunger 126. Alternatively, the gripping head 128 is configured to be formed integral with the plunger 126. Optionally, the gripping head 128 may be manufactured from a metal material. Alternatively, the gripping head 128 may be manufactured from other materials, such as a plastic material.

A finger ring 130 is provided at the rear of the housing 120. In the illustrated embodiment, the finger ring 130 is formed integral with the housing 120. Alternatively, the finger ring 130 may be separate from the housing 120 and coupled to the housing 120 or to the plunger 126. The finger ring 130 is configured to receive one of the operator's fingers so that the operator can hold the tool 110. As the tool 110 is moved in an untwisting direction, the finger ring 130 spins about the operator's finger. In an exemplary embodiment, the housing 120 includes a finger grip 132 at the actuation end 124. The finger grip 132 is configured to receive one or more of the operator's fingers so the operator can stabilize the tool 110 within the operator's hand.

The housing 120 includes the cavity 160 extending only partially between the wire gripping end 122 and the actuation end 124. The plunger 126 and gripping head 128 are both received within the cavity 160. A biasing mechanism 162 is also received in the cavity 160. The biasing mechanism 162 extends between the housing 120 and the plunger 126. The biasing mechanism 162 is used to force the plunger 126 rearward to the retracted position. A trigger 164 is coupled to the housing 120. The trigger 164 is pivoted to force the plunger 126 and gripping head 128 to move from the retracted position to the advanced position. The trigger 164 includes a lever 166 external to the housing 120. The trigger 164 includes a ram 168 opposite the lever 166. When the lever 166 is actuated, the ram 168 is moved towards the plunger 126. As the ram 168 is moved, the plunger 126 is forced from the retracted position to the advanced position. When the trigger 164 is released, the biasing mechanism 162 forces the plunger 126 to return to the retracted position.

The gripping head 128 includes a hook 170 at the distal end thereof. The hook 170 is used to capture the wires 12 and hold the wires 12 during use. The hook 170 has an inwardly facing pocket 172 that receives the wires 12. The hook 170 extends to a tip 174. The tip 174 wraps around the wires 12 to capture the wires 12 within the pocket 112. In the retracted position, the tip 174 is at least partially received within the cavity 160. For example, the gripping head 128 is pulled into the cavity 160 such that the tip 174 is positioned inward from the wire gripping end 122. Optionally, the housing may include a pocket 176 at the wire gripping end 122. The hook 170 is received within the pocket 176 when the gripping head 128 is in the retracted position. Alternatively, the tip 174 may not be positioned in the cavity 160 in the retracted position.

In an exemplary embodiment, the gripping head 128 includes a cutting blade 180. The housing 120 includes a window 182 generally aligned with the cutting blade 182 that opens to the cavity 160. Optionally the window 182 may be open at a side of the housing 120 to receive a cable filler or wire therein for cutting. In an exemplary embodiment, the plunger 126 includes a cutting blade 184. The housing 120 includes a window 186 generally aligned with cutting blade 184 for stripping a cable jacket from the cable.

Figure 6:
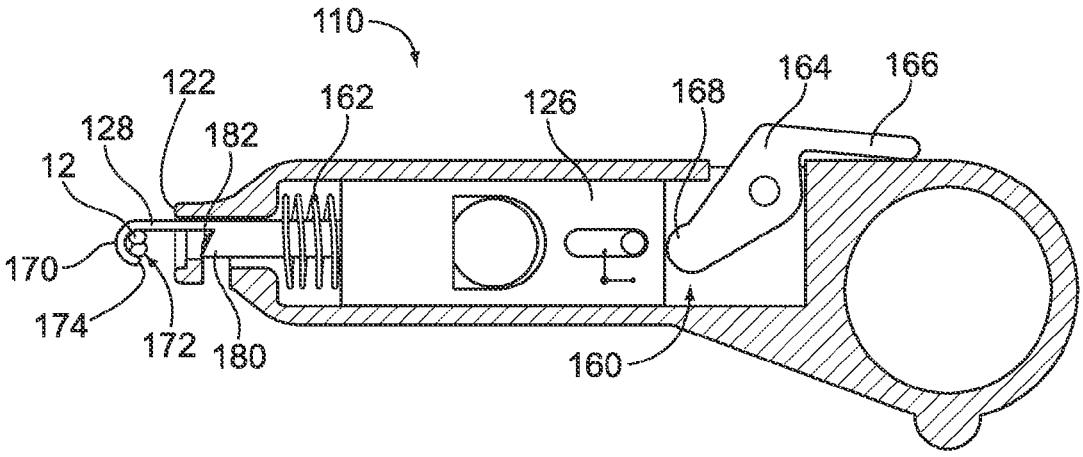
FIG. 6 is a cross-sectional view of the wire untwisting tool shown in FIG. 5 in an advanced state.

FIG. 6 is a cross-sectional view of the wire untwisting tool 110 in an advanced state. In the advanced state, the plunger 126 and the gripping head 128 are actuated forward within the cavity 160. When actuated, the gripping head 128 is advanced out of the cavity 160 to expose the hook 170. In the advanced position, the tip 174 is positioned external of the wire gripping end 122. The pocket 172 is exposed and is configured to receive the wires 12 therein.

In use, the trigger 164 is actuated to move the plunger 126 and gripping head 128 to the advanced position. For example, the lever 166 is pressed downward toward the housing 120. As the lever 166 is pressed downward, the ram 168 is moved forward, which similarly advances the plunger 126 and gripping head 128 forward. When the gripping head 128 is advanced, the cutting blade 180 is also advanced. The cutting blade 180 shears the cable filler or wire received in the windows 182. When the plunger 126 is advanced, the biasing mechanism 162 is compressed. When the plunger 126 is released, the biasing mechanism 162 forces the plunger 126 to return to the retracted position.

Figure 7:
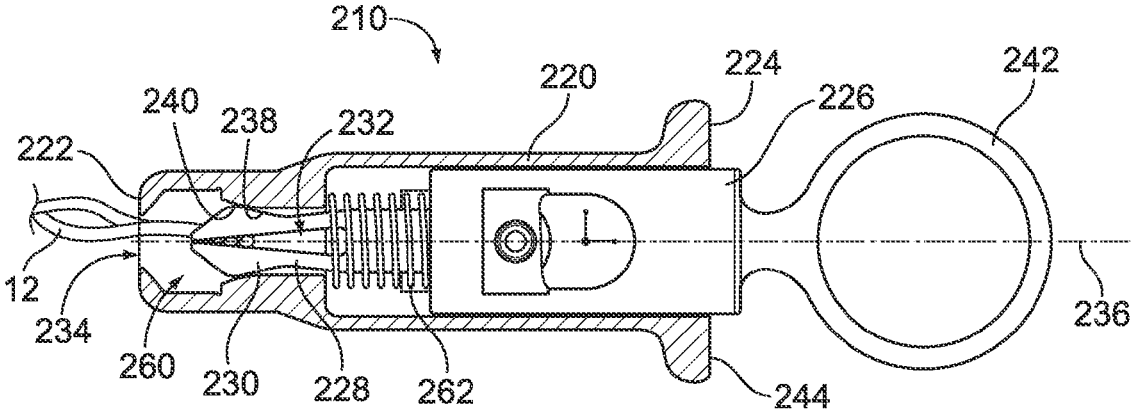
FIG. 7 is a cross-sectional view of another alternative wire untwisting tool in a retracted state.

FIG. 7 is a cross-sectional view of another alternative wire untwisting tool 210 in a retracted state. The tool 210 is similar to the wire untwisting tool 10 in some respects, however the tool 210 includes a different gripping feature for securing the wires 12 with respect the tool 210.

The tool 210 includes a housing 220 having a wire gripping end 222 at a front of the housing 220 and an actuation end 224 at a rear of the housing 220. The tool 210 includes a plunger 226 received in a cavity 260 of the housing 220. The plunger 226 is movable within the cavity 260 between a retracted, or rearward, position (shown in FIG. 7) and an actuated, or forward, position (shown in FIG. 8).

A gripping head 228 is provided at a front of the plunger 226. The gripping head 228 is also received within the cavity 260. The gripping head 228 is movable with the plunger 226 between the retracted position and the actuated position. The gripping head 228 holds the wires 12. In an exemplary embodiment, the gripping head 228 is separately provided from the plunger 226, and is coupled to the plunger 226 such that the gripping head 228 is movable with the plunger 226. Alternatively, the gripping head 228 is configured to be formed integral with the plunger 226. Optionally, the gripping head 228 may be manufactured from a metal material. Alternatively, the gripping head 228 may be manufactured from other materials, such as a plastic material.

The gripping head 228 includes a pair of jaws 230 that are separated from one another by a gap 232. The wires 12 may be positioned between the jaws 230 within the gap 232. For example, the housing 220 may have an opening 234 at the wire gripping end 222. The wires 12 may extend through the opening 234 generally along a longitudinal axis 236 of the tool 210 into the gap 232 between the jaws 230. In the retracted position, the jaws 230 are closed toward one another, such that the jaws 230 fill portions of the gap 232. The jaws 230 are forced toward one another such that the wires 12 may be held tightly between the jaws 230. In an exemplary embodiment, the jaws 230 include ramps 238 on the outer surfaces thereof. The ramps 238 engage interior walls 240 of the housing 220 that define the cavity 260. As the gripping head 228 is moved from the advanced position to the retracted position, the ramps 238 engage the interior walls 240 and the interior walls 240 force the jaws 232 closed.

A finger ring 242 is provided at the rear of the housing 220. In the illustrated embodiment, the finger ring 242 is formed integral with the plunger 226. The finger ring 242 is configured to receive one of the operator's fingers so that the operator can hold the tool 210. As the tool 216 is moved in an untwisting direction, the finger ring 242 spin's about the operator's finger. In an exemplary embodiment, the housing 220 includes a finger grip 244 at the actuation end 224. The finger grip 244 is configured to receive one or more of the operator's fingers so the operator can stabilize the tool 210 within the operator's hand.

The housing 220 includes the cavity 260 extending between the wire gripping end 222 and the actuation end 224. The plunger 226 and gripping head 228 are both received within the cavity 260. A biasing mechanism 262 is also received in the cavity 260. The biasing mechanism 262 extends between the housing 220 and the plunger 226. The biasing mechanism 262 is used to force the plunger 226 rearward to the retracted position.

Figure 8:
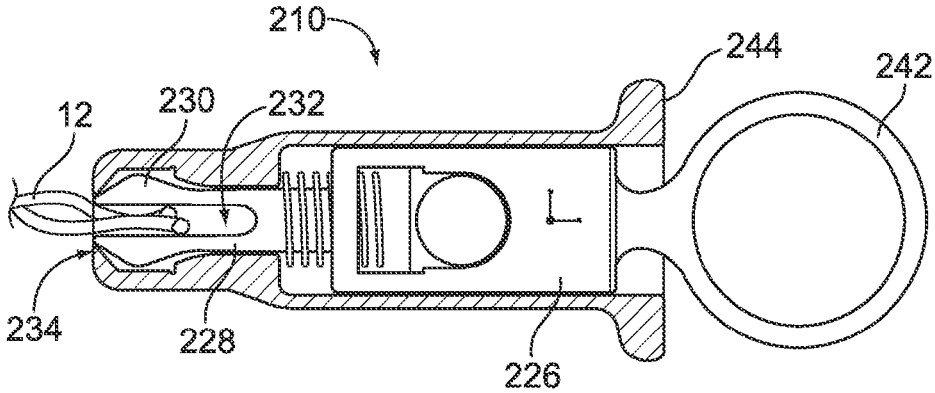
FIG. 8 is a cross-sectional view of the wire untwisting tool shown in FIG. 7 in an advanced state.

FIG. 8 is a cross-sectional view of the wire untwisting tool 210 in an advanced state. In the advanced state, the plunger 226 and the gripping head 228 are actuated forward within the cavity 260. When actuated, the gripping head 228 is advanced within the cavity 260. The jaws 230 are able to spread apart to widen the gap 232 the therebetween. The jaws 230 may be positioned proximate to the opening 234 such that the wires 12 may be loaded into the gap 232 between the jaws 230.

The plunger 226 and gripping head 228 may be advanced by pushing the finger ring 242 and/or pulling the finger grip 244. The operator then loads the twisted pair of wires 12 into the gripping head 228 through the opening 234. The operator then allows the plunger 226 to return to the retracted position, which also resets the gripping head 228 to the retracted position. As the gripping head 228 returns to the retracted position, the jaws 230 are closed, thus gripping the wires 12 therebetween.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A wire untwisting tool comprising:

a housing extending along a longitudinal axis between a wire gripping end and an actuation end, the housing having a cavity; and a plunger received in the cavity, the plunger being movable between a retracted position and an actuated position, the plunger having a gripping head movable with the plunger between the retracted position and the actuated position, the gripping head being configured to hold the twisted pair of wires in the retracted position such that the wires are pinched between the wire gripping end and the gripping head to restrict relative movement of the wires with respect to the housing;

wherein rotation of the housing in an untwisting direction about an axis not coincident with the longitudinal axis untwists the wires.

2. The tool of claim 1, wherein the wire is fixedly held remote from the gripping end to define the location of the axis of rotation of the housing, the housing being configured to be rotated about the location at which the wire is fixedly held.

3. The tool of claim 1, the plunger being moved between the retracted position and the actuated position along the longitudinal axis.

4. The tool of claim 1, wherein the plunger is movable in a linear actuation direction, the gripping head being configured to hold the wire such that the wire is oriented nonparallel to the actuation direction.

5. The tool of claim 1, the housing and the plunger being rotated together in the untwisting direction such that the plunger is not rotated relative to the housing with both the housing and the plunger being pivoted in a direction generally perpendicular to the longitudinal axis.

6. The tool of claim 1, wherein the housing is rotated in the untwisting direction such that the wire gripping end moves circumferentially along a first path having a first diameter in a tangential direction that is tangent to the longitudinal axis and the actuation end moves circumferentially along a second path having a second diameter larger than the first diameter in a tangential direction that is tangent to the longitudinal axis.

7. The tool of claim 1, wherein the housing is rotated along a frustoconical path with the actuation end being at the base of the frustoconical path.

8. The tool of claim 1, wherein the housing is rotated in the untwisting direction such that the actuation end moves relative to the wire gripping end.

9. The tool of claim 1, wherein the housing includes an opening in the wire gripping end, the gripping head moving through the opening, the gripping head being configured to engage the wire and pull a portion of the wire into the opening such that the wire is creased in the opening and engages the wire gripping end of the housing.

10. The tool of claim 1, further comprising a finger ring positioned outward of the actuation end of the housing, the finger ring being configured to receive an operator's finger, the finger ring being configured to spin about the operator's finger when the housing is rotated in the untwisting direction.

11. The tool of claim 1, further comprising a biasing mechanism received in the cavity between the housing and the plunger, the biasing mechanism generally forcing the plunger to the retracted position along the longitudinal axis.

12. The tool of claim 1, wherein the griping head comprises one of a hook and jaws to grip the wire.

13. The tool of claim 1, further comprising a cutting blade coupled to the plunger, the cutting blade being movable with the plunger in a cutting direction along the longitudinal axis.

14. The tool of claim 1, further comprising a trigger coupled to the housing, the trigger being operated to actuate the plunger, wherein movement of the trigger in an operation direction causes movement of the plunger in an actuation direction that is nonparallel to the operation direction.

15. A wire untwisting tool comprising:

a housing extending along a longitudinal axis between a wire gripping end and an actuation end, the housing having a cavity;

a plunger received in the cavity, the plunger being movable between a retracted position and an actuated position, the plunger having a gripping head movable with the plunger between the retracted position and the actuated position, the gripping head being configured to hold the twisted pair of wires in the retracted position such that the wires are pinched between the wire gripping end and the gripping head to restrict relative movement of the wires with respect to the housing; and a finger ring positioned outward of the actuation end of the housing, the finger ring being configured to receive an operator's finger, the finger ring being configured to spin about the operator's finger when the housing is rotated in an untwisting direction, wherein rotation of the housing in the untwisting direction about an axis not coincident with the longitudinal axis untwists the wires.

16. The tool of claim 15, wherein the wire is fixedly held remote from the gripping end to define the location of the axis of rotation of the housing, the housing being configured to be rotated about the location at which the wire is fixedly held.

17. The tool of claim 15, the plunger being moved between the retracted position and the actuated position along the longitudinal axis, the plunger and the housing being rotated together in the untwisting direction generally perpendicular to the longitudinal axis such that the plunger is not rotated relative to the housing as the housing and the plunger are rotated in the untwisting direction.

18. The tool of claim 15, wherein the housing is rotated along a frustoconical path with the actuation end being at the base of the frustoconical path and being moved in a tangential direction that is tangent to the longitudinal axis.

19. The tool of claim 15, wherein the housing includes an opening in the wire gripping end, the gripping head moving through the opening, the gripping head being configured to engage the wire and pull a portion of the wire into the opening such that the wire is creased in the opening.

20. The tool of claim 15, further comprising a biasing mechanism received in the cavity between the housing and the plunger, the biasing mechanism generally forcing the plunger to the retracted position along the longitudinal axis.

* * * * *